US010937563B2

(12) United States Patent
Imamura et al.

(10) Patent No.: US 10,937,563 B2
(45) Date of Patent: Mar. 2, 2021

(54) BUS BAR UNIT

(71) Applicant: HONDA MOTOR CO., LTD., Tokyo (JP)

(72) Inventors: Takehiro Imamura, Saitama (JP); Misa Aneha, Saitama (JP); Takahiro Mihara, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/800,796

(22) Filed: Feb. 25, 2020

(65) Prior Publication Data

US 2020/0273599 A1 Aug. 27, 2020

(30) Foreign Application Priority Data

Feb. 25, 2019 (JP) ..... JP2019-031952

(51) Int. Cl.
*H01R 25/14* (2006.01)
*H01B 5/02* (2006.01)
*H01R 9/00* (2006.01)

(52) U.S. Cl.
CPC ..... *H01B 5/02* (2013.01); *H01R 9/00* (2013.01); *H01R 2201/10* (2013.01)

(58) Field of Classification Search
CPC ..... H01R 25/14; H02G 5/00
See application file for complete search history.

(56) References Cited

U.S. PATENT DOCUMENTS 8,625,256 B2 * 1/2014 Schmid ..... H02B 1/20 174/70 B
8,784,131 B2 * 7/2014 Jeon ..... H01R 31/06 439/212
10,069,261 B2 * 9/2018 Sakurada ..... H01R 43/048
2011/0316373 A1 12/2011 Kobayashi et al.
2013/0068495 A1 * 3/2013 Hadi ..... H01R 25/14 174/68.2
2019/0165635 A1 5/2019 Kumakura et al.

FOREIGN PATENT DOCUMENTS

JP 2011-209159 A 10/2011
JP 2015-033201 A 2/2015
JP 2018-038129 A 3/2018
WO WO 2011/055806 A1 5/2011

OTHER PUBLICATIONS

Nov. 17, 2020, Japanese Office Action Issued for related JP application No. 2019-031952.

* cited by examiner

*Primary Examiner* — Chau N Nguyen
(74) *Attorney, Agent, or Firm* — Paratus Law Group, PLLC

(57) ABSTRACT

A bus bar unit related to one aspect includes: a first bus bar and a second bus bar. The first bus bar and the second bus bar are arranged side by side in a second direction orthogonal to a first direction as viewed from the first direction. The first bus bar includes, as viewed from the first direction, a first straight line portion, a first inclined portion, and a first bent portion. The second bus bar includes, as viewed from the first direction, a second straight line portion, a second inclined portion, and a second bent portion. In an end surface on a second bus bar side of the first bent portion, a distance between the first bent portion and the second inclined portion is longer than a distance between the first bent portion and the second straight line portion.

2 Claims, 3 Drawing Sheets

BUS BAR UNIT

CROSS-REFERENCE TO RELATED APPLICATIONS

This application is based on and claims priority under 35 USC 119 from Japanese Patent Application No. 2019-031952 filed on Feb. 25, 2019, the contents of which are incorporated herein by reference.

TECHNICAL FIELD

The present invention relates to a bus bar unit including a plurality of bus bars.

BACKGROUND ART

Conventionally, a rotary electric machine is mounted as a drive source in an electric vehicle or the like. Further, there has been known that a bus bar unit including a plurality of bus bars is used as a component that electrically connects the rotary electric machine and a power conversion device for supplying electric power to the rotary electric machine.

In the bus bar unit, in a case in which a length of the bus bar is long, an influence of a manufacturing error or the like on the bus bar is increased. When terminal portions at both ends of the bus bar are connected to the rotary electric machine and a control device, the bus bar may be deformed and the adjacent bus bars may come into contact with each other to cause a short circuit.

As a bus bar unit that prevents the adjacent bus bars from coming into contact with each other, for example, Patent Literature 1 (JP-A-2018-038129) discloses a bus bar unit including a mold portion that molds an entire circumference of at least one bus bar with a resin or the like.

However, the bus bar unit of Patent Literature 1 requires cost and a manufacturing process for forming the mold portion.

Therefore, in the bus bar unit, it is more desirable that an insulation distance between the adjacent bus bars is ensured regardless of the mold portion or the like.

The present invention provides a bus bar unit that can ensure an insulation distance between adjacent bus bars and prevent the adjacent bus bars from coming into contact with each other and causing a short circuit.

SUMMARY

A bus bar unit related to one aspect includes: a first bus bar and a second bus bar that have a flat plate shape. The first bus bar and the second bus bar are arranged side by side in a second direction orthogonal to a first direction as viewed from the first direction. The first bus bar includes, as viewed from the first direction, a first straight line portion extending linearly in a third direction orthogonal to the second direction, a first inclined portion extending linearly on a side opposite to a side where the second bus bar is arranged in the second direction with respect to the first straight line portion, as a distance from the first straight line portion increases in the third direction, and a first bent portion connecting the first straight line portion and the first inclined portion. The second bus bar includes, as viewed from the first direction, a second straight line portion arranged on the same plane as the first straight line portion and extending linearly substantially parallel to the first straight line portion, a second inclined portion arranged on the same plane as the first inclined portion and extending linearly substantially parallel to the first inclined portion, and a second bent portion arranged on the same plane as the first bent portion and connecting the second straight line portion and the second inclined portion. In an end surface on a second bus bar side of the first bent portion, a distance between the first bent portion and the second inclined portion is longer than a distance between the first bent portion and the second straight line portion.

According to the present invention, an insulation distance between the first bus bar and the second bus bar can be ensured, and the first bus bar and the second bus bar can be prevented from coming into contact with each other and causing a short circuit.

DESCRIPTION OF EMBODIMENTS

Hereinafter, an embodiment of a bus bar unit according to the present invention will be described with reference to the accompanying drawings.

Figure 1:
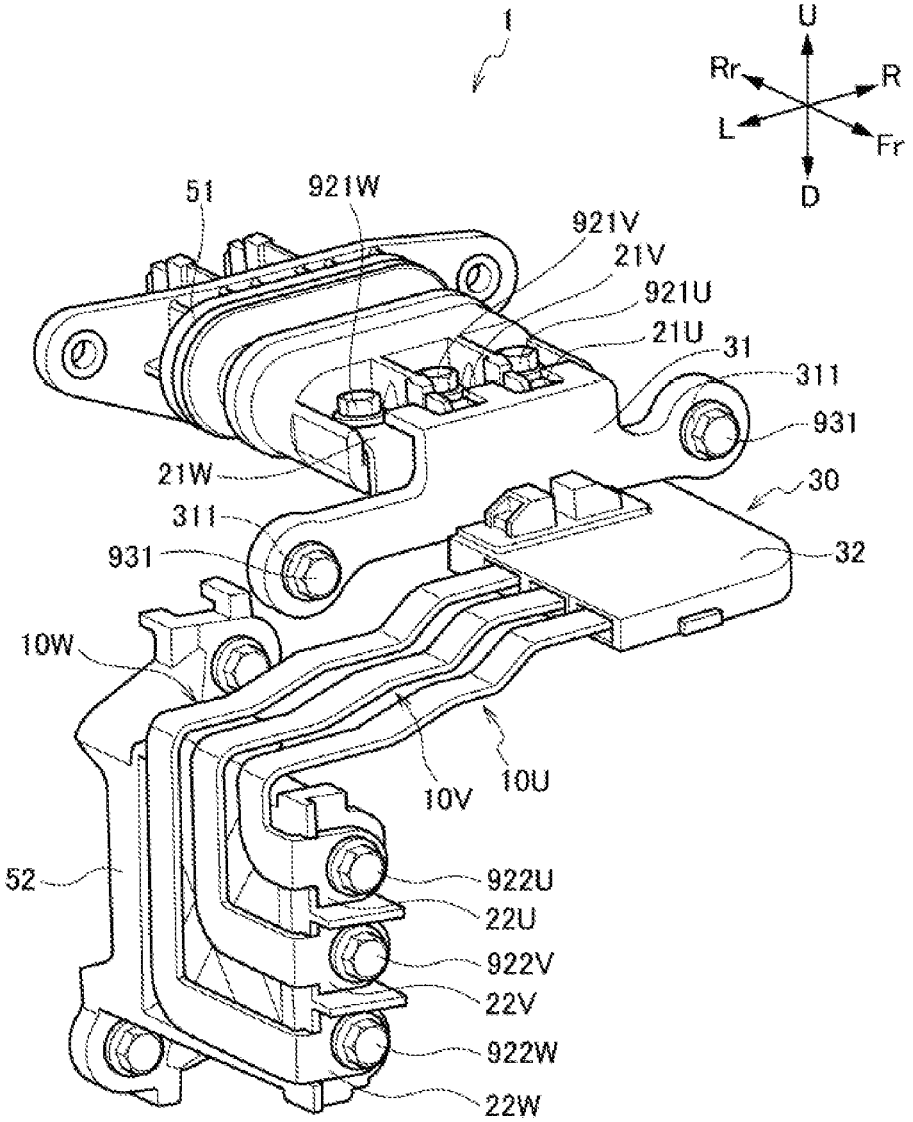
FIG. 1 is a perspective view showing a state in which a bus bar unit according to an embodiment of the present invention is mounted on a terminal block.
Figure 2:
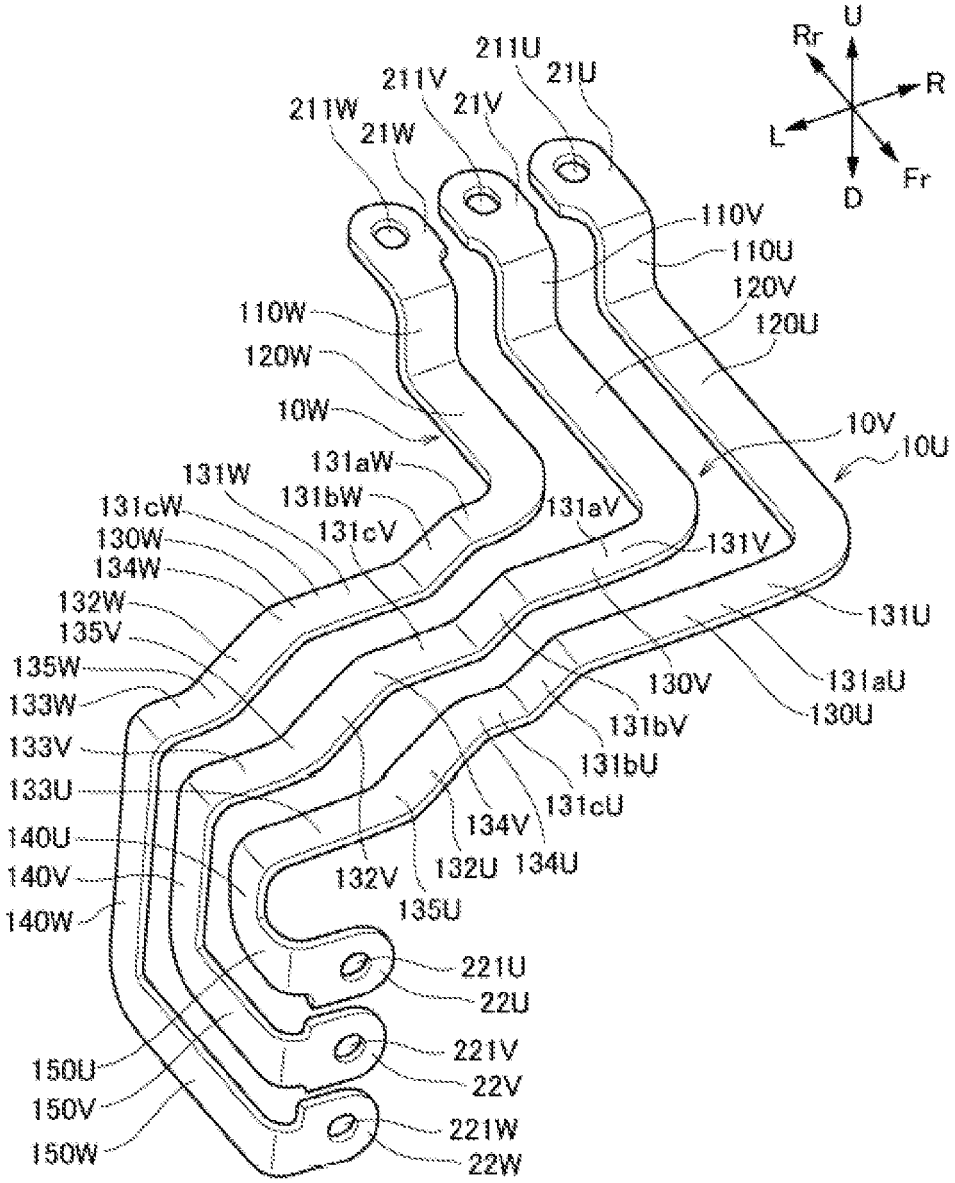
FIG. 2 is a perspective view of the bus bar unit of FIG. 1 in a state in which a cover member is removed.

As shown in FIGS. 1 and 2, a bus bar unit 1 includes three bus bars 10U, 10V, and 10W, and a cover member 30 that collectively covers the three bus bars 10U, 10V, and 10W.

In this specification, in order to simplify the description, front, rear, left, right, upper and lower directions of the bus bar unit 1 are defined as shown in the drawings, and a front direction thereof is indicated by Fr, a rear direction thereof is indicated by Rr, a right direction thereof is indicated by R, a left direction thereof is indicated by L, an upper direction is indicated by U, and a lower direction is indicated by D, respectively. However, the directions shown in the drawing are independent of directions of a device or the like on which the bus bar unit 1 is mounted.

The three bus bars 10U, 10V, and 10W have a flat plate shape extending from a first terminal block 51 to a second terminal block 52 arranged on a lower left side of the first terminal block 51.

The three bus bars 10U, 10V, and 10W include first terminal portions 21U, 21V, and 21W having a flat surface substantially perpendicular to an upper-lower direction and fixed to the first terminal portion 51, first extending portions 110U, 110V, and 110W extending downward from front ends of the first terminal portions 21U, 21V, and 21W, second extending portions 120U, 120V, and 120W extending forward from lower ends of the first extending portions 110U, 110V, and 110W, third extending portions 130U, 130V, and 130W extending leftward from front ends of the second extending portions 120U, 120V, and 120W, fourth extending portions 140U, 140V, and 140W extending downward from left ends of the third extending portions 130U, 130V, and 130W, fifth extending portions 150U, 150V, and 150W extending forward from lower ends of the fourth extending portions 140U, 140V, and 140W, and second terminal portions 22U, 22V, and 22W provided at front ends of the fifth extending portions 150U, 150V, and 150W and having a flat surface substantially perpendicular to a front-rear direction, respectively.

The three bus bars 10U, 10V, and 10W are arranged such that the extending portions 110U to 150U, 110V to 150V, and 110W to 150W extend in parallel to each other.

The arrangement of the three bus bars 10U, 10V, and 10W can be set as appropriate, but in the present embodiment, the first terminal portions 21U, 21V, and 21W, the first extending portions 110U, 110V, and 110W, and the second extending portions 120U, 120V, 120W are arranged in this order from the right to the left, the third extending portions 130U, 130V, and 130W, and the fourth extending portions 140U, 140V, and 140W are arranged in this order from the front to the rear, and the fifth extending portions 150U, 150V, and 150W, and the second terminal portions 22U, 22V, and 22W are arranged in this order from the top to the bottom.

The first terminal portions 21U, 21V, and 21W are provided with bolt insertion holes 211U, 211V, and 211W on a plane substantially perpendicular to the upper-lower direction. The first terminal portions 21U, 21V, and 21W are fastened to the first terminal block 51 by bolts 921U, 921V, and 921W inserted into the bolt insertion holes 211U, 211V, and 211W, respectively. Further, the first terminal portions 21U, 21V, and 21W are electrically connected to, for example, a power conversion device (not shown) in each phase of a U-phase, a V-phase, and a W-phase via the first terminal block 51.

The second terminal portions 22U, 22V, and 22W are provided with bolt insertion holes 221U, 221V, and 221W on a plane substantially perpendicular to the front-rear direction. The second terminal portions 22U, 22V, and 22W are fastened to the second terminal block 52 by bolts 922U, 922V, and 922W inserted into the bolt insertion holes 22W, 221V, and 221W, respectively. Further, the second terminal portions 22U, 22V, and 22W are electrically connected to, for example, coils (not shown) of a rotary electric machine in each phase of a U-phase, a V-phase, and a W-phase via the second terminal block 52.

Since the three bus bars 10U, 10V, and 10W include the first extending portions 110U, 110V, and 110W and the fourth extending portions 140U, 140V, and 140W extending in the upper-lower direction, the second extending portions 120U, 120V, and 120W and the fifth extending portions 150U, 150V, and 150W extending in the front-rear direction, and the third extending portions 130U, 130V, and 130W extending in a left-right direction, the three bus bars 10U, 10V, and 10W extend in three directions perpendicular to each other.

Therefore, when the first terminal portions 21U, 21V, and 21W and the second terminal portions 22U, 22V, and 22W are respectively fastened to the first terminal block 51 and the second terminal block 52, even if there is a manufacturing error in the bus bars 10U, 10V, and 10W, stress can be distributed in the three directions perpendicular to each other at the extending portions extending in the upper-lower direction, the front-rear direction, and the left-right direction.

The cover member 30 includes a cover base 31 attached to a case (not shown) of the rotary electric machine, and a cover portion 32 that is held by the cover base 31 and covers the three bus bars 10U, 10V, and 10W, for example.

The cover base 31 is provided with bolt insertion holes 311. In the present embodiment, the pair of bolt insertion holes 311 are provided at both left and right ends of the cover base 31. The cover base 31 is fixed to, for example, the case (not shown) of the rotary electric machine by bolts 931 inserted into the pair of bolt insertion holes 311.

The cover portion 32 covers the second extending portions 120U, 120V, and 120W and a portion of a right end side of the third extending portions 130U, 130V, and 130W of the three bus bars 10U, 10V, and 10W. The three bus bars 10U, 10V, and 10W are arranged side by side on the same plane inside the cover member 30.

In this way, since the bus bars 10U, 10V, and 10W are configured such that the second extending portions 120U, 120V, and 120W extending in the left-right direction, and a portion of the right end side of the third extending portions 130U, 130V, and 130W extending in the left-right direction are covered by the cover portion 32, even if the bus bars 10U, 10V, and 10W are relatively moved in the front-rear direction, the left-right direction, and the upper-lower direction, the bus bars 10U, 10V, and 10W are caught by the cover portion 32, and do not fall off from the cover portion 32. Therefore, after the bus bar unit 1 is assembled, the three bus bars 10U, 10V, and 10W can be handled as one body by the cover member 30.

The cover member 30 is configured to not come into contact with the three bus bars 10U, 10V, and 10W, for example, in a state of being attached to the case of the rotary electric machine. Accordingly, even when the bus bars 10U, 10V, and 10W vibrate, generation of abnormal noise due to contact between the bus bars 10U, 10V, and 10W and the cover member 30 can be prevented.

The three bus bars 10U, 10V, and 10W are not fixed to the cover member 30, and can move to some extent within the cover member 30. Accordingly, even if there is the manufacturing error in the bus bars 10U, 10V, and 10W, the first terminal portions 21U, 21V, and 21W, and the second terminal portions 22U, 22V, and 22W can be easily fastened to the first terminal block 51 and the second terminal block 52, respectively.

Figure 3:
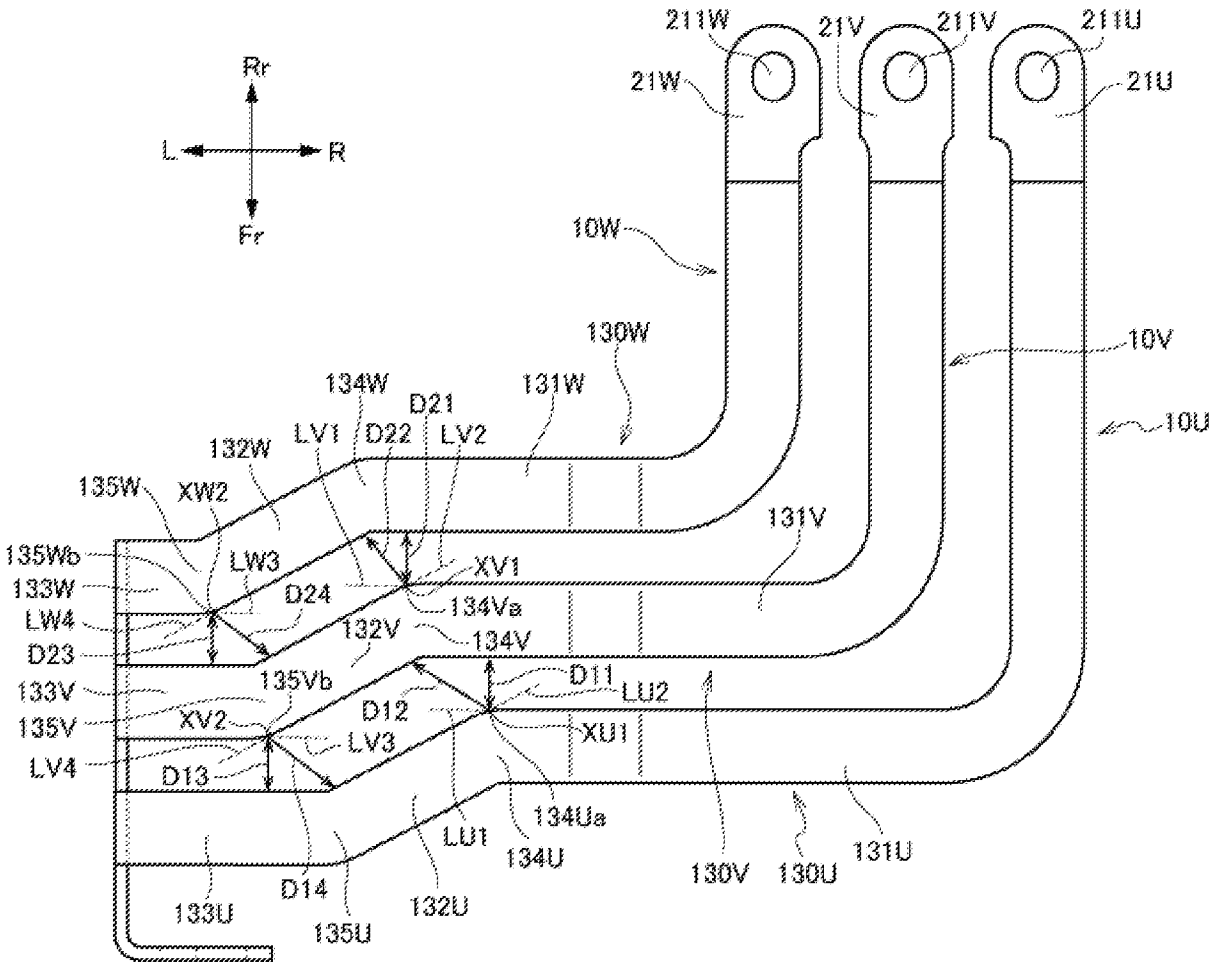
FIG. 3 is a view of the bus bar unit of FIG. 2 as viewed from above in a state in which the cover member is removed.

As shown in FIGS. 2 and 3, the third extending portions 130U, 130V, and 130W of the bus bars 10U, 10V, and 10W are arranged in this order from the front to the rear as viewed from above.

The third extending portions 130U, 130V, and 130W include, as viewed from above, right straight line portions 131U, 131V, and 131W extending linearly in the left-right direction from a right end, forward inclined portions 132U, 132V, and 132W that are arranged at left sides of the right straight line portions 131U, 131V, and 131W, and are inclined forward and extend linearly from a right side toward a left side, and left straight line portions 133U, 133V, and 133W that are arranged at left sides of the forward inclined portions 132U, 132V, and 132W, and extend linearly in the left-right direction, and left ends of the left straight line portions 133U, 133V, and 133W are left ends of the third extending portions 130U, 130V, and 130W, respectively.

Left ends of the right straight line portions 131U, 131V, and 131W and right ends of the forward inclined portions 132U, 132V, and 132W are connected by right bent portions 134U, 134V, and 134W, and left ends of the forward inclined portions 132U, 132V, and 132W and right ends of the left straight line portions 133U, 133V, and 133W are connected by left bent portions 135U, 135V, and 135W, respectively.

The right straight line portions 131U, 131V, and 131W include, as viewed from the front, upper straight line portions 131*a*U, 131*a*V, and 131*a*W extending in the left-right direction from the right end, downward inclined portions 131*b*U, 131*b*V, and 131*b*W that are inclined downward and extend linearly toward the left side from left ends of the upper straight line portions 131*a*U, 131*a*V, and 131*a*W, and lower straight line portions 131*c*U, 131*c*V, and 131*c*W extending in the left-right direction from left ends of the downward inclined portions 131*b*U, 131*b*V, 131*b*W, and left ends of the lower straight line portions 131$c$U, 131$c$V, and 131$c$W are the left ends of the right straight line portions 131U, 131V, and 131W, respectively.

The right straight line portions 131U, 131V, and 131W are arranged on the same plane and extend substantially parallel to each other. More specifically, the upper straight line portions 131$a$U, 131$a$V, and 131$a$W are arranged on the same plane perpendicular to the upper-lower direction and extend substantially parallel to each other, and the lower straight line portions 131$c$U, 131$c$V, and 131$c$W are arranged on the same plane perpendicular to the upper-lower direction and extend substantially parallel to each other. In addition, the downward inclined portions 131$b$U, 131$b$V, and 131$b$W extend at the same angle of inclination and are formed side by side in the front-rear direction, at the same position in the left-right direction.

The forward inclined portions 132U, 132V, and 132W are arranged on the same plane and extend substantially parallel to each other. The right bent portions 134U, 134V, and 134W are arranged on the same plane. The left straight line portions 133U, 133V, and 133W are arranged on the same plane and extend substantially parallel to each other. The left bent portions 135U, 135V, and 135W are arranged on the same plane.

In the present embodiment, the forward inclined portions 132U, 132V, and 132W, the right bent portions 134U, 134V, and 134W, the left straight line portions 133U, 133V, and 133W, and the left bent portions 135U, 135V, and 135W are arranged on the same plane as the lower straight line portions 131$c$U, 131$c$V, and 131$c$W of the right straight line portions 131U, 131V, and 131W, respectively.

The right bent portion 134V is formed on a left side of the right bent portion 134U, and the right bent portion 134W is formed on a left side of the right bent portion 134V. Similarly, the left bent portion 135V is formed on a left side of the left bent portion 135U, and the left bent portion 135W is formed on a left side of the left bent portion 135V.

In an end surface 134Ua of the right bent portion 134U of the bus bar 10U on a bus bar 10V side, a distance D12 between the right bent portion 134U and the forward inclined portion 132V of the bus bar 10V is longer than a distance D11 between the right bent portion 134U and the right straight line portion 131V of the bus bar 10V.

Regarding the distance D11 and the distance D12, a base point of the right bent portion 134U on the end surface 134Ua of the right bent portion 134U on the bus bar 10V side is an intersection point XU1 between an extension line LU1 of an end surface of the right straight line portion 131U of the bus bar 10U on the bus bar 10V side and an extension line LU2 of an end surface of the forward inclined portion 132U of the bus bar 10U on the bus bar 10V side, as viewed from above. The same applies to a case in which the end surface 134Ua is chamfered as in the present embodiment. That is, the distance D11 is a distance between the intersection point XU1 and the right straight line portion 131V of the bus bar 10V, and the distance D12 is a distance between the intersection point XU1 and the forward inclined portion 132V of the bus bar 10V.

Accordingly, since it can be ensured that an insulation distance between the right bent portion 134U of the bus bar 10U and the forward inclined portion 132V of the bus bar 10V adjacent to the bus bar 10U is longer than an insulation distance between the right bent portion 134U of the bus bar 10U and the right straight line portion 131V, the right bent portion 134U of the bus bar 10U can be prevented from coming into contact with the forward inclined portion 132V of the bus bar 10V adjacent to the bus bar 10U, so that occurrence of a short circuit in the bus bar unit 1 can be prevented.

In an end surface 134Va of the right bent portion 134V of the bus bar 10V on a bus bar 10W side, a distance D22 between the right bent portion 134V and the forward inclined portion 132W of the bus bar 10W is longer than a distance D21 between the right bent portion 134V and the right straight line portion 131W of the bus bar 10W.

Regarding the distance D21 and the distance D22, a base point of the right bent portion 134V on the end surface 134Va of the right bent portion 134U on the bus bar 10W side is an intersection point XV1 between an extension line LV1 of an end surface of the right straight line portion 131V of the bus bar 10V on the bus bar 10W side and an extension line LV2 of an end surface of the forward inclined portion 132V of the bus bar 10V on the bus bar 10W side, as viewed from above. The same applies to a case in which the end surface 134Va is chamfered as in the present embodiment. That is, the distance D21 is a distance between the intersection point XV1 and the right straight line portion 131W of the bus bar 10W, and the distance D22 is a distance between the intersection point XV1 and the forward inclined portion 132W of the bus bar 10W.

Accordingly, since it can be ensured that an insulation distance between the right bent portion 134V of the bus bar 10V and the forward inclined portion 132W of the bus bar 10W adjacent to the bus bar 10V is longer than an insulation distance between the right bent portion 134V of the bus bar 10V and the right straight line portion 131W, the right bent portion 134V of the bus bar 10V can be prevented from coming into contact with the forward inclined portion 132W of the bus bar 10W adjacent to the bus bar 10V, so that the occurrence of the short circuit in the bus bar unit 1 can be prevented.

In an end surface 135Vb of the left bent portion 135V of the bus bar 10V on a bus bar 10U side, a distance D14 between the left bent portion 135V and the forward inclined portion 132U of the bus bar 10U is longer than a distance D13 between the left bent portion 135V and the left straight line portion 133U of the bus bar 10U.

Regarding the distance D13 and the distance D14, a base point of the left bent portion 135V on the end surface 135Vb of the left bent portion 135V on the bus bar 10U side is an intersection point XV2 between an extension line LV3 of an end surface of the left straight line portion 133V of the bus bar 10V on the bus bar 10U side and an extension line LV4 of an end surface of the forward inclined portion 132V of the bus bar 10V on the bus bar 10U side, as viewed from above. The same applies to a case in which the end surface 135Vb is chamfered as in the present embodiment. That is, the distance D13 is a distance between the intersection point XV2 and the left straight line portion 133U of the bus bar 10U, and the distance D14 is a distance between the intersection point XV2 and the forward inclined portion 132U of the bus bar 10U.

Accordingly, since it can be ensured that an insulation distance between the left bent portion 135V of the bus bar 10V and the forward inclined portion 132U of the bus bar 10U adjacent to the bus bar 10V is longer than an insulation distance between the left bent portion 135V of the bus bar 10V and the left straight line portion 133U, the left bent portion 135V of the bus bar 10V can be prevented from coming into contact with the forward inclined portion 132U of the bus bar 10U adjacent to the bus bar 10V, so that the occurrence of the short circuit in the bus bar unit 1 can be prevented.

In an end surface 135Wb of the left bent portion 135W of the bus bar 10W on the bus bar 10V side, a distance D24 between the left bent portion 135W and the forward inclined portion 132V of the bus bar 10V is longer than a distance D23 between the left bent portion 135W and the left straight line portion 133V of the bus bar 10V.

Regarding the distance D23 and the distance D24, a base point of the left bent portion 135W on the end surface 135Wb of the left bent portion 135W on the bus bar 10V side is an intersection point XW2 between an extension line LW3 of an end surface of the left straight line portion 133W of the bus bar 10W on the bus bar 10V side and an extension line LW4 of an end surface of the forward inclined portion 132W of the bus bar 10W on the bus bar 10V side, as viewed from above. The same applies to a case in which the end surface 135Wb is chamfered as in the present embodiment. That is, the distance D23 is a distance between the intersection point XW2 and the left straight line portion 133V of the bus bar 10V, and the distance D24 is a distance between the intersection point XW2 and the forward inclined portion 132V of the bus bar 10V.

Accordingly, since it can be ensured that an insulation distance between the left bent portion 135W of the bus bar 10W and the forward inclined portion 132V of the bus bar 10V adjacent to the bus bar 10W is longer than an insulation distance between the left bent portion 135W of the bus bar 10W and the left straight line portion 133V, the left bent portion 135W of the bus bar 10W can be prevented from coming into contact with the forward inclined portion 132V of the bus bar 10V adjacent to the bus bar 10W, so that the occurrence of the short circuit in the bus bar unit 1 can be prevented.

Although the embodiment of the present invention have been described above, the present invention is not limited to the above-described embodiments, and modifications, improvements, or the like can be made as appropriate.

At least the following matters are described in the present specification. Components corresponding to the above-described embodiments are shown in parentheses, but the present invention is not limited thereto.

(1) A bus bar unit (bus bar unit 1) including:

a first bus bar (bus bar 10U) and a second bus bar (bus bar 10V) that have a flat plate shape, wherein the first bus bar and the second bus bar are arranged side by side in a second direction (front-rear direction) orthogonal to a first direction (upper-lower direction) viewed from the first direction, wherein the first bus bar includes, as viewed from the first direction, a first straight line portion (right straight line portion 131U) extending linearly in a third direction (left-right direction) orthogonal to the second direction, a first inclined portion (forward inclined portion 132U) extending linearly on a side (front side) opposite to a side (rear side) where the second bus bar is arranged in the second direction with respect to the first straight line portion, as a distance from the first straight line portion increases in the third direction, and a first bent portion (right bent portion 134U) connecting the first straight line portion and the first inclined portion, wherein the second bus bar includes, as viewed from the first direction, a second straight line portion (right straight line portion 131V) arranged on the same plane as the first straight line portion and extending linearly substantially parallel to the first straight line portion, a second inclined portion (forward inclined portion 132V) arranged on the same plane as the first inclined portion and extending linearly substantially parallel to the first inclined portion, and a second bent portion (right bent portion 134V) arranged on the same plane as the first bent portion and connecting the second straight line portion and the second inclined portion, and wherein in an end surface (end surface 134Ua) of the first bent portion on a second bus bar side, a distance (distance D12) between the first bent portion and the second inclined portion is longer than a distance (distance D11) between the first bent portion and the second straight line portion.

According to (1), since it can be ensured that an insulation distance between the first bent portion of the first bus bar and the second inclined portion of the second bus bar is longer than an insulation distance between the first bent portion of the first bus bar and the second straight line portion of the second bus bar, the first bent portion of the first bus bar can be prevented from coming into contact with the second inclined portion of the second bus bar, so that occurrence of a short circuit in the bus bar unit can be prevented.

(2) The bus bar unit according to (1), wherein the first bus bar includes a first direction extending portion (first extending portion 110U, fourth extending portion 140U) extending in the first direction, and a second direction extending portion (second extending portion 120U, fifth extending portion 150U) extending in the second direction, and wherein the second bus bar includes a third direction extending portion (first extending portion 110V, a fourth extending portion 140V) extending in the first direction, and a fourth direction extending portion (second extending portion 120V, fifth extending portion 150V) extending in the second direction.

According to (2), the first bus bar includes the first direction extending portion extending in the first direction, the second direction extending portion extending in the second direction, and the first straight line portion extending in the third direction. Accordingly, when both end portions of the first bus bar are connected to an electric device or the like, even if there is a manufacturing error in the first bus bar, stress can be distributed in three directions perpendicular to each other by the first direction extending portion, the second direction extending portion, and the first straight line portion.

Similarly, the second bus bar includes the third direction extending portion extending in the first direction, the fourth direction extending portion extending in the second direction, and the second straight line portion extending in the third direction. Accordingly, when both end portions of the second bus bar are connected to the electric device or the like, even if there is a manufacturing error in the second bus bar, stress can be distributed in three directions perpendicular to each other by the third direction extending portion, the fourth direction extending portion, and the second straight line portion.

(3) The bus bar unit according to (1) further including:

a third bus bar (bus bar 10W) having a flat plate shape, wherein the third bus bar includes, as viewed from the first direction, a third straight line portion (right straight line portion 131W) arranged on the same plane as the first straight line portion and the second straight line portion and extending linearly substantially parallel to the second straight line portion, a third inclined portion (forward inclined portion 132W) arranged on the same plane as the first straight line portion and the second straight line portion, and extending linearly substantially parallel to the second inclined portion, and a third bent portion (right bent portion 134W) arranged on the same plane as the first bent portion and the second bent portion, and connecting the third straight line portion and the third inclined portion, and wherein in an end surface (end surface 134Va) of the second bent portion on a third bus bar side, a distance (distance D22) between the second bent portion and the third inclined portion is longer than a distance (distance D21) between the first bent portion and the second straight line portion.

According to (3), the bus bar unit further includes the third bus bar, and it can be ensured that an insulation distance between the second bent portion of the second bus bar and the third inclined portion of the third bus bar is longer than an insulation distance between the second bent portion of the second bus bar and the third straight line portion of the third bus bar, so that the second bent portion of the second bus bar can be prevented from coming into contact with the third inclined portion of the third bus bar, and the occurrence of the short circuit in the bus bar unit can be prevented.

(4) The bus bar unit according to (3), wherein the first bus bar includes a first direction extending portion (first extending portion 110U, fourth extending portion 140U) extending in the first direction, and a second direction extending portion (second extending portion 120U, fifth extending portion 150U) extending in the second direction, wherein the second bus bar includes a third direction extending portion (first extending portion 110V, fourth extending portion 140V) extending in the first direction, and a fourth direction extending portion (second extending portion 120V, fifth extending portion 150V) extending in the second direction, and wherein the third bus bar includes a fifth direction extending portion (first extending portion 110W, fourth extending portion 140W) extending in the first direction, and a sixth direction extending portion (second extending portion 120W, fifth extending portion 150W) extending in the second direction.

According to (4), the first bus bar includes the first direction extending portion extending in the first direction, the second direction extending portion extending in the second direction, and the first straight line portion extending in the third direction. Accordingly, when both end portions of the first bus bar are connected to an electric device or the like, even if there is a manufacturing error in the first bus bar, stress can be distributed in three directions perpendicular to each other by the first direction extending portion, the second direction extending portion, and the first straight line portion.

Similarly, the second bus bar includes the third direction extending portion extending in the first direction, the fourth direction extending portion extending in the second direction, and the second straight line portion extending in the third direction. Accordingly, when both end portions of the second bus bar are connected to the electric device or the like, even if there is a manufacturing error in the second bus bar, stress can be distributed in three directions perpendicular to each other by the third direction extending portion, the fourth direction extending portion, and the second straight line portion.

Further, the third bus bar includes the fifth direction extending portion extending in the first direction, the sixth direction extending portion extending in the second direction, and the third straight line portion extending in the third direction. Accordingly, when both end portions of the third bus bar are connected to the electric device or the like, even if there is a manufacturing error in the third bus bar, stress can be distributed in three directions perpendicular to each other by the fifth direction extending portion, the sixth direction extending portion, and the third straight line portion.

What is claimed is:

1. A bus bar unit comprising:

a first bus bar, a second bus bar, and a third bus bar that each have a flat plate shape, wherein the first bus bar and the second bus bar are arranged side by side in a second direction orthogonal to a first direction as viewed from the first direction, wherein the first bus bar includes, as viewed from the first direction, a first straight line portion extending linearly in a third direction orthogonal to the second direction, a first inclined portion extending linearly on a side opposite to a side where the second bus bar is arranged in the second direction with respect to the first straight line portion, as a distance from the first straight line portion increases in the third direction, and a first bent portion connecting the first straight line portion and the first inclined portion, wherein the second bus bar includes, as viewed from the first direction, a second straight line portion arranged on the same plane as the first straight line portion and extending linearly substantially parallel to the first straight line portion, a second inclined portion arranged on the same plane as the first inclined portion and extending linearly substantially parallel to the first inclined portion, and a second bent portion arranged on the same plane as the first bent portion and connecting the second straight line portion and the second inclined portion, wherein in an end surface on a second bus bar side of the first bent portion, a distance between the first bent portion and the second inclined portion is longer than a distance between the first bent portion and the second straight line portion, wherein the third bus bar includes, as viewed from the first direction, a third straight line portion arranged on the same plane as the first straight line portion and the second straight line portion, and extending linearly substantially parallel to the second straight line portion, a third inclined portion arranged on the same plane as the first straight line portion and the second straight line portion, and extending linearly substantially parallel to the second inclined portion, and a third bent portion arranged on the same plane as the first bent portion and the second bent portion, and connecting the third straight line portion and the third inclined portion, and wherein in an end surface of the second bent portion on a third bus bar side, a distance between the second bent portion and the third inclined portion is longer than a distance between the first bent portion and the second straight line portion.

2. The bus bar unit according to claim 1, wherein the first bus bar includes a first direction extending portion extending in the first direction, and a second direction extending portion extending in the second direction, wherein the second bus bar includes a third direction extending portion extending in the first direction, and a fourth direction extending portion extending in the second direction, and wherein the third bus bar includes a fifth direction extending portion extending in the first direction, and a sixth direction extending portion extending in the second direction.

* * * * *